US011557451B1

(12) United States Patent
Cooney et al.

(10) Patent No.: US 11,557,451 B1
(45) Date of Patent: Jan. 17, 2023

(54) HIGH VOLTAGE HIGH CURRENT FUSE WITH ARC INTERRUPTER

(71) Applicant: Hamilton Sundstrand Corporation, Charlotte, NC (US)

(72) Inventors: Robert C. Cooney, Janesville, WI (US); Nhia Yang, Roscoe, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 17/544,398

(22) Filed: Dec. 7, 2021

(51) Int. Cl.

| | |
|---|---|
| ***H01H 85/38*** | (2006.01) |
| ***H01H 85/02*** | (2006.01) |
| ***H01H 85/165*** | (2006.01) |
| ***H01H 85/20*** | (2006.01) |

(52) U.S. Cl.
CPC ..... *H01H 85/0241* (2013.01); *H01H 85/165* (2013.01); *H01H 85/205* (2013.01); *H01H 2085/381* (2013.01)

(58) Field of Classification Search
CPC ..... H01H 85/0241; H01H 85/165; H01H 85/175; H01H 85/205; H01H 2085/381; H01H 37/76–761; H01H 2037/762–763
See application file for complete search history.

(56) References Cited

U.S. PATENT DOCUMENTS

| | | | | |
|---|---|---|---|---|
| 4,963,850 | A * | 10/1990 | Ranjan | H01H 85/17 337/273 |
| 6,430,019 | B1 * | 8/2002 | Martenson | H01C 7/126 361/103 |
| 6,556,119 | B1 * | 4/2003 | Lell | H01H 37/323 337/182 |
| 9,570,260 | B2 * | 2/2017 | Yang | H01H 61/02 |
| 10,573,876 | B1 | 2/2020 | Zeng et al. | |
| 10,937,619 | B2 * | 3/2021 | Yoneda | H01H 85/08 |
| 10,964,988 | B2 | 3/2021 | Fernandez-Galindo et al. | |
| 2009/0189730 | A1 * | 7/2009 | Oh | H01H 85/10 337/186 |
| 2018/0190414 | A1 * | 7/2018 | Durth | H01T 1/14 |
| 2020/0066465 | A1 * | 2/2020 | Moszynski | H01H 33/88 |
| 2020/0357594 | A1 | 11/2020 | Urrea et al. | |

FOREIGN PATENT DOCUMENTS

| | | | |
|---|---|---|---|
| EP | 3883004 | A1 | 9/2021 |
| JP | 2013258016 | A * | 12/2013 |

OTHER PUBLICATIONS

Translation of JP 2013258016 A.*

* cited by examiner

*Primary Examiner* — Jacob R Crum
(74) *Attorney, Agent, or Firm* — Locke Lord LLP; Joshua L. Jones; Scott D. Wofsy

(57) ABSTRACT

A fuse includes a housing. A bus bar extends through the housing. An arc interrupter positioned inside the housing. A biasing element is compressed between the housing and the arc interrupter to bias the arc interrupter toward the bus bar to separate two portions of the bus bar during circuit interruption to mitigate arcing from one portion of the bus bar to the other portion of the bus bar. The bus bar includes a pocket defined therein wherein the bus bar is of a first material, and wherein a second material is seated within the pocket. In another aspect, a fuse includes a fuse housing and a bus bar extending through the housing. The bus bar includes a pocket defined therein. The bus bar is of a first material, wherein a second material is seated within the pocket.

10 Claims, 3 Drawing Sheets

HIGH VOLTAGE HIGH CURRENT FUSE WITH ARC INTERRUPTER

BACKGROUND

1. Field

The present disclosure relates to electrical circuit protection, and more particularly to fuses for high voltage and/or high current such as in electric, hybrid or more-electric aerospace applications.

2. Description of Related Art

When high energy fuses open, an arc, or plasma, is formed that is electrically conductive, reducing the effectiveness of the fuse to break or open a faulty circuit. Traditional high voltage, high amperage fuses for power feeders include sand filled cavities. The shorting energy melts the sand to glass, creating a very good electrical insulator that prevents the arc from conducting. However, these sand-filled fuses can be very large and costly. In addition, typical high energy fuses create high contact resistance power joints or create constrictions in the power bus routing. The conventional techniques have been considered satisfactory for their intended purpose. However, there is an ever present need for improved systems and methods for improved fuses such as for high voltage and/or high current applications. This disclosure provides a solution for this need.

SUMMARY

A fuse includes a housing. A bus bar extends through the housing. An arc interrupter is positioned inside the housing. A biasing element is compressed between the housing and the arc interrupter to bias the arc interrupter toward the bus bar to separate two portions of the bus bar during circuit interruption to mitigate arcing from one portion of the bus bar to the other portion of the bus bar. The bus bar includes a pocket defined therein wherein the bus bar is of a first material, and wherein a second material is seated within the pocket.

The housing can be ceramic or can be coated inside with a ceramic material. The pocket and second material can be within the housing. The first material can have a higher melting temperature than the second material. Both the first material and the second material can be electrically conductive. A reservoir can be defined in the housing below the pocket in the bus bar with respect to gravity for receiving the second material in molten form during circuit interrupt. A flow diverter can extend upward from the reservoir wherein the flow diverter is configured to divert molten material away from a center of the housing. The flow diverter, biasing member, and arc interrupter can be configured to drive the arc interrupter into the flow diverter during circuit interrupt to form a barrier between the two portions of the bus bar.

Lateral edges of the arc interrupter can be toleranced close to lateral walls of the housing to reduce or prevent flow of particles around the arc interrupter. Lateral edges of the arc interrupter can include laterally extending flanges, giving the arc interrupter an H-shaped cross-sectional profile. The laterally extending flanges can form a tortuous path with the housing to reduce or prevent flow of particles around the arc interrupter.

A first portion of the bus bar outside the housing can include at least one fastener opening therethrough for connecting the bus bar to a first contact in an electrical line. A second portion of the bus bar outside the housing opposite the first portion can include at least one fastener opening therethrough for connecting the bus bar to a second contact in an electrical line in series with the first contact through the bus bar.

In another aspect, a fuse includes a fuse housing and a bus bar extending through the housing. The bus bar includes a pocket defined therein. The bus bar is of a first material, wherein a second material is seated within the pocket.

The pocket and second material can be within the housing. The first material can have a higher melting temperature than the second material. Both the first material and the second material can be electrically conductive. A reservoir can be defined in the housing below the pocket in the bus bar with respect to gravity for receiving the second material in molten form during circuit interrupt. A flow diverter can extend upward from the reservoir wherein the flow diverter is configured to divert molten material away from a center of the housing. The housing can be coated inside with a ceramic material. A first portion of the bus bar outside the housing can include at least one fastener opening therethrough for connecting the bus bar to a first contact in an electrical line. A second portion of the bus bar outside the housing opposite the first portion can include at least one fastener opening therethrough for connecting the bus bar to a second contact in an electrical line in series with the first contact through the bus bar.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
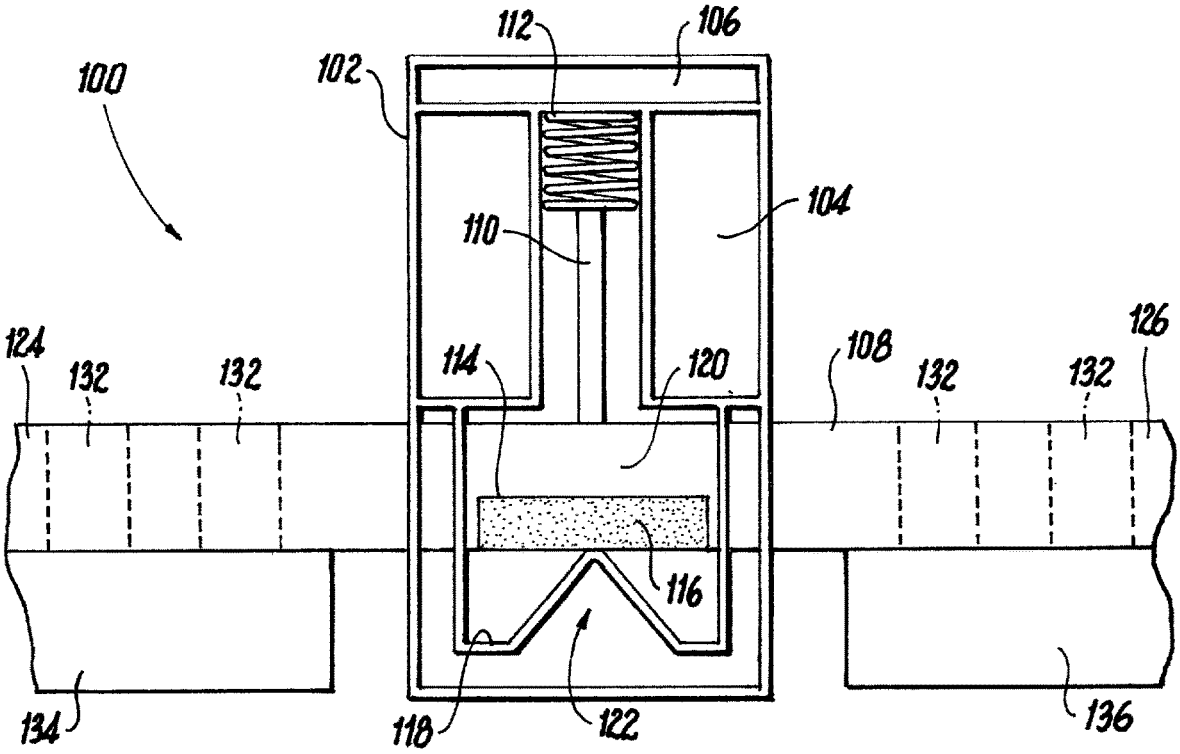
FIG. 1 is a schematic side elevation view of an embodiment of a fuse constructed in accordance with the present disclosure, showing the bus bar and arc interrupter.

Reference will now be made to the drawings wherein like reference numerals identify similar structural features or aspects of the subject disclosure. For purposes of explanation and illustration, and not limitation, a partial view of an embodiment of a fuse in accordance with the disclosure is shown in FIG. 1 and is designated generally by reference character 100. Other embodiments of systems in accordance with the disclosure, or aspects thereof, are provided in FIGS. 2-5, as will be described. The systems and methods described herein can be used to mitigate and/or eliminate arcing through plasma and/or particles in a fuse housing after the fuse's bus bar has melted to interrupt a faulted circuit.

The fuse 100 includes a housing 102 manufactured of a ceramic material or any non-conductive material coated inside with a ceramic material 104 and enclosed by a cap 106. A bus bar 108 extends through the housing 102. An arc interrupter 110 is positioned inside the housing 102. A biasing element 112, such as a spring or the like, is compressed between the cap 106 of the housing 102 and the arc interrupter 110 to bias the arc interrupter 110 toward and against the bus bar 108

With continued reference to FIG. 1, the bus bar includes a pocket 114 defined therein. The wherein the bus bar 108 is of a first material, and a second material 116 is seated within the pocket 114. Both the pocket 114 and second material 116 are within the housing 102. The first material, i.e. the bus bar 108, has a higher melting temperature than the second material 116. Both the first material and the second material 116 are electrically conductive.

Figure 2:
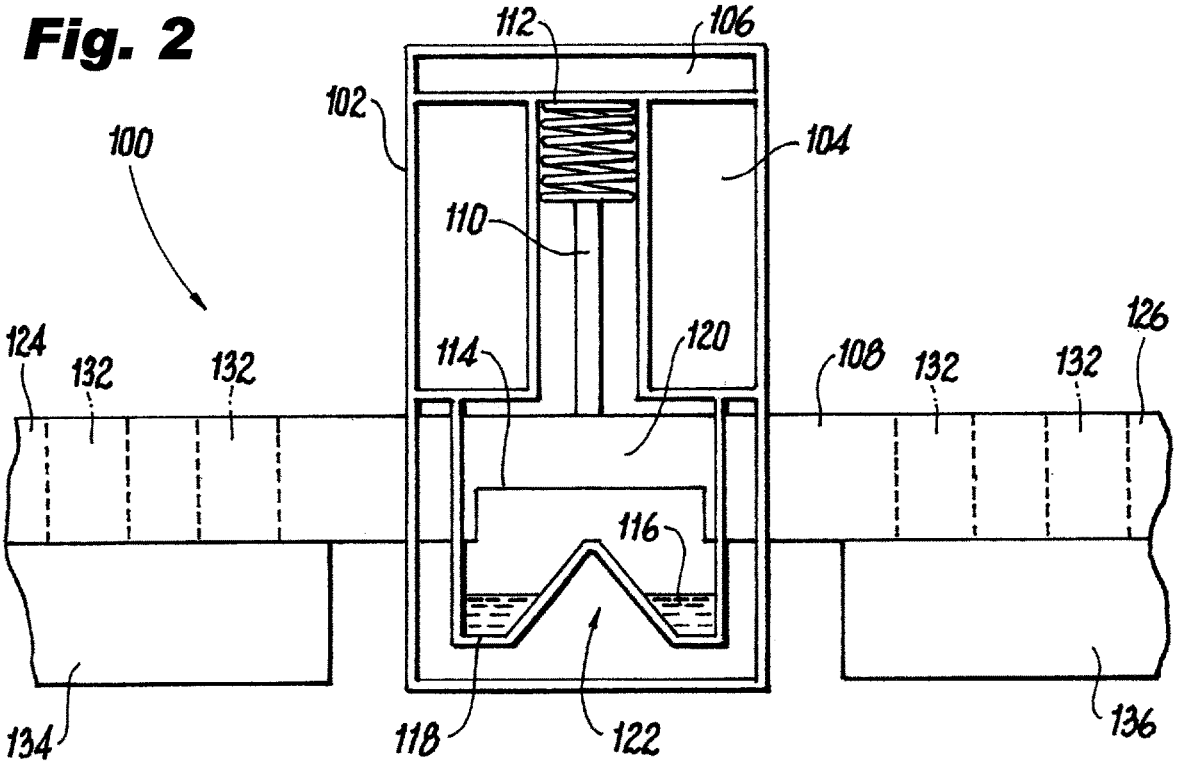
FIG. 2 is a schematic side elevation view of the fuse of FIG. 1, showing the second material from the pocket of the bus bar melted at the beginning of a circuit interrupt event.

With reference now to FIG. 2, a reservoir 118 is defined in the housing 102 below the pocket 114 in the bus bar 108 with respect to gravity, i.e. as oriented in FIGS. 1-3, for receiving the second material 116 in molten form during circuit interrupt. As it has the lower melting temperature, during a circuit interrupt event, the second material 116 melts before the first material of the bus bar 108, as shown in FIG. 2. The reduction in electrical cross-sectional area of the bus bar 108 intensifies the heating in the narrow portion 120 of the bus bar 108 proximate the pocket 114, helping insure the narrow portion 120 is next to melt.

Figure 3:
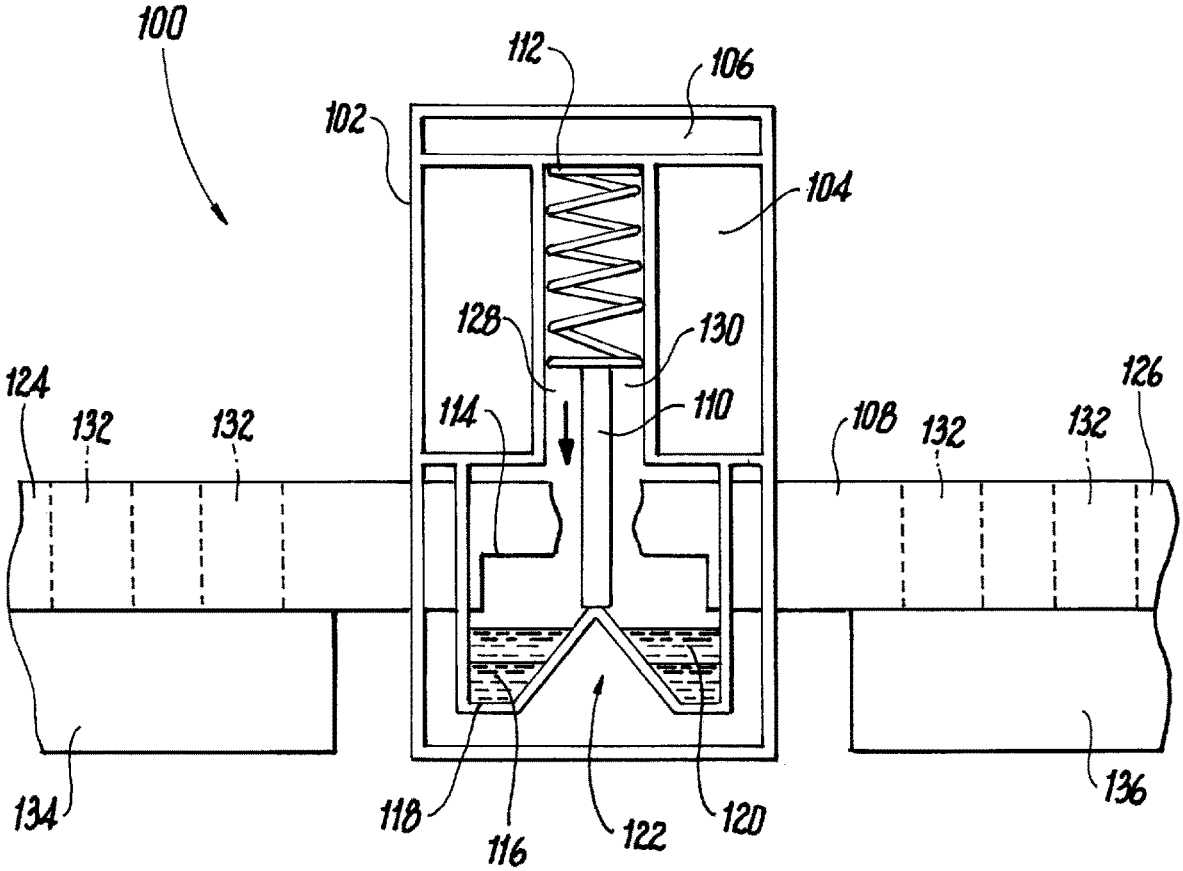
FIG. 3 is a schematic side elevation view of the fuse of FIG. 1, showing the first or main material of the bus bar also melted, with the arc interrupter blocking between the two separate portions of the bus bar to inhibit arcing from one portion to the other of the bus bar.

With reference now to FIG. 3, a flow diverter 122 extends upward from the reservoir 118. The flow diverter 122 is configured to divert molten material (the second material 116 and material from the narrow portion 120 of the bus bar 108) away from a center of the housing 102. The flow diverter 122, biasing member 112, and arc interrupter 110 are configured to drive the arc interrupter 110 into, i.e., against, the flow diverter 122 during circuit interrupt as the narrow portion 120 of the bus bar 108 melts/ablates away. The movement of the arc interrupter 110 is from the position shown in FIG. 2 to the position shown in FIG. 3. This forms a barrier between the two portions 124, 126 of the bus bar 108, as well as between the left portion 128 of the interior of the housing 102 and the right portion 130 of the interior of the housing 102 as oriented in FIG. 3 to separate the two portions 124, 126 and 138, 130, respectively, of the bus bar 102 and the interior of the housing 102 during circuit interruption. This separation mitigates and/or eliminates arcing from one portion 124, 126 of the bus bar 108 to the other portion 124, 126 of the bus bar 108, to help ensure complete circuit breaking.

Figure 4:
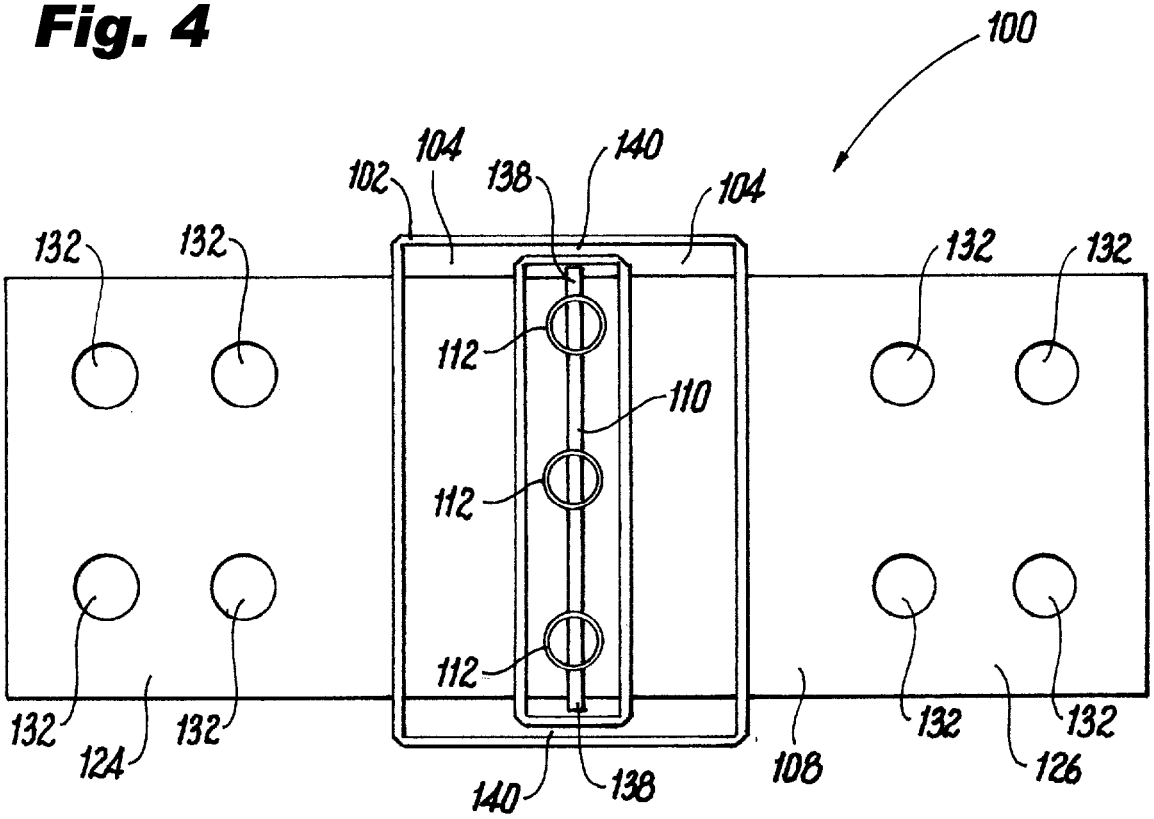
FIG. 4 is a schematic plan view of the fuse of FIG. 1, showing lateral edges of the arc interrupter closely toleranced to the lateral walls of the housing.
Figure 5:
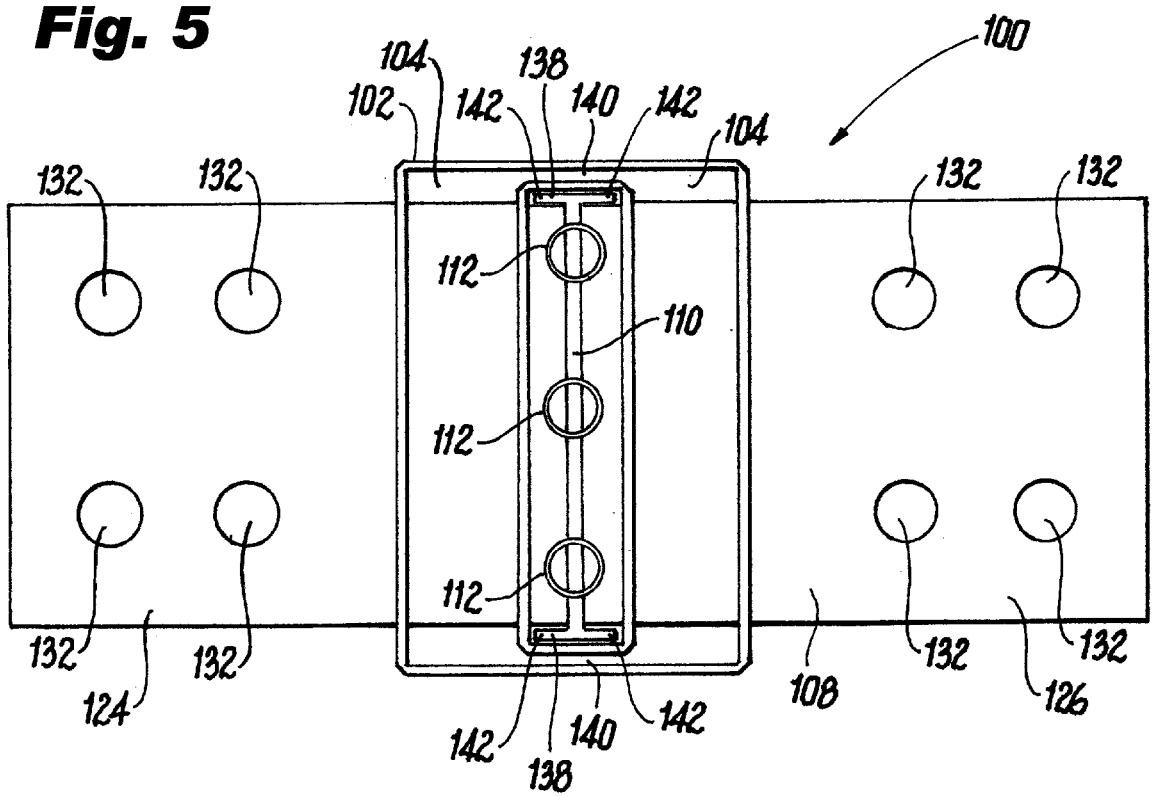
FIG. 5 is a schematic plan view of the fuse of FIG. 1, showing another arc interrupter having an H-shaped cross-sectional profile.

With continued reference to FIG. 3, a first portion 124 of the bus bar 108 outside of the housing 102 can include at least one fastener opening 132, e.g. four as shown in FIGS. 4-5 or any other suitable number, therethrough for connecting the bus bar 108 to a first contact 134 in an electrical line. A second portion 126 of the bus bar outside the housing 102 opposite the first portion 124 can similarly include at least one fastener opening 132 therethrough for connecting the bus bar 108 to a second contact 136 in an electrical line in series with the first contact 134 through the bus bar when there is no need for circuit interrupting, e.g. as shown in FIG. 1.

With reference now to FIG. 4, lateral edges 138 of the arc interrupter are toleranced close to lateral walls 140 of the housing 102 to reduce or prevent flow of particles around the arc interrupter 110 during a circuit interrupt event as shown in FIGS. 2-3. As shown in FIG. 5, this tolerancing can be relaxed, e.g. if the lateral edges 138 of the arc interrupter include laterally extending flanges 142, giving the arc interrupter 110 an H-shaped or other appropriate cross-sectional profile as viewed in plan view as in FIG. 5. The laterally extending flanges 142 form a tortuous path with the housing 102 to reduce or prevent flow of particles around the arc interrupter 110 during a circuit interrupt event as shown in FIGS. 2-3.

Potential benefits of systems and methods as disclosed herein include the following. Fuse 102 can facilitate increases in the present aerospace industry feeder and component sizes to allow for megawatt power level electrical systems for electric propulsion and other high energy applications. The breaking capacity (interrupting rating) of the fuse 102 can be tuned to different amperages and ambient temperatures by varying the higher and lower melting material's material composition and geometry. The spring-loaded arc interrupter 110, when deployed, can be an insulation barrier between the input and output, e.g. bus bar portions 124, 126, which prevents power conduction. The fuse housing can be ceramic or ceramic coated which prevents/reduces arc propagation and contains foreign object damage (FOD) created by the arc. Multiple bolt locations, e.g. openings 132, on each side of the fuse 102 allow for lower contact resistance with the bus bar conductors 124, 126, increasing the performance of the fuse. The cross-section of the fuse bus bar 108 can be tuned to match the input/output bus bars or contacts 134, 136.

The methods and systems of the present disclosure, as described above and shown in the drawings, provide for mitigating and/or eliminating arcing through plasma and/or particles in a fuse housing. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A fuse comprising:

a housing;

a bus bar extending through the housing;

an arc interrupter positioned inside the housing; and a biasing element compressed between the housing and the arc interrupter to bias the arc interrupter toward the bus bar to separate two portions of the bus bar during circuit interruption to mitigate arcing from one portion of the bus bar to the other portion of the bus bar, wherein lateral edges of the arc interrupter include laterally extending flanges, giving the arc interrupter an H-shaped cross-sectional profile, wherein the laterally extending flanges form a tortuous path with the housing to reduce or prevent flow of particles around the arc interrupter.

2. The fuse as recited in claim 1, wherein the bus bar includes a pocket defined therein wherein the bus bar is of a first material, and wherein a second material is seated within the pocket.

3. The fuse as recited in claim 2, wherein the pocket and second material are within the housing.

4. The fuse as recited in claim 3, wherein the first material has a higher melting temperature than the second material.

5. The fuse as recited in claim 4, wherein both the first material and the second material are electrically conductive.

6. The fuse as recited in claim 3, wherein a reservoir is defined in the housing below the pocket in the bus bar with respect to gravity for receiving the second material in molten form during circuit interrupt.

7. The fuse as recited in claim 6, wherein a flow diverter extends upward from the reservoir wherein the flow diverter is configured to divert molten material away from a center of the housing.

8. The fuse as recited in claim 7, wherein the flow diverter, biasing element, and arc interrupter are configured to drive the arc interrupter into the flow diverter during circuit interrupt to form a barrier between the two portions of the bus bar.

9. The fuse as recited in claim 1, wherein the housing is ceramic or is coated inside with a ceramic material.

10. The fuse as recited in claim 1, wherein a first portion of the bus bar outside the housing includes at least one fastener opening therethrough for connecting the bus bar to a first contact in an electrical line, and wherein a second portion of the bus bar outside the housing opposite the first portion includes at least one fastener opening therethrough for connecting the bus bar to a second contact in an electrical line in series with the first contact through the bus bar.

* * * * *